US007753623B2

(12) United States Patent
Heindl et al.

(10) Patent No.: US 7,753,623 B2
(45) Date of Patent: Jul. 13, 2010

(54) CONNECTING PROFILE FOR INTERCONNECTING THREE SHEET PILE WALL COMPONENTS AND AN ARRANGEMENT OF SHEET PILE WALL COMPONENTS COMPRISING SUCH A CONNECTING PROFILE

(75) Inventors: Richard Heindl, Munich (DE); Rob Wendt, Rapid City, SD (US)

(73) Assignee: PilePro LLC, Rapid City, SD (US)

( * ) Notice: Subject to any disclaimer, the term of this patent is extended or adjusted under 35 U.S.C. 154(b) by 0 days.

(21) Appl. No.: 12/028,705

(22) Filed: Feb. 8, 2008

(65) Prior Publication Data

US 2008/0219776 A1 Sep. 11, 2008

Related U.S. Application Data

(63) Continuation of application No. PCT/EP2006/007208, filed on Jul. 21, 2006.

(30) Foreign Application Priority Data

Aug. 9, 2005 (DE) ..... 10 2005 037 564
Jan. 2, 2006 (DE) ..... 10 2006 000 624

(51) Int. Cl.
*E02D 5/08* (2006.01)

(52) U.S. Cl. ..... 405/279; 405/281

(58) Field of Classification Search ..... 405/279, 405/278, 277, 276, 274, 281
See application file for complete search history.

(56) References Cited

U.S. PATENT DOCUMENTS

| | | | | |
|---|---|---|---|---|
| 968,450 | A | 8/1910 | Conkling et al. | |
| 1,032,109 | A * | 7/1912 | Buckingham | 405/279 |
| 1,098,077 | A * | 5/1914 | Annison | 405/279 |
| 2,128,428 | A | 8/1938 | Murray, Jr. | |
| 3,688,508 | A | 9/1972 | Taylor | |

FOREIGN PATENT DOCUMENTS

| | | |
|---|---|---|
| DE | 3907348 A1 | 9/1990 |
| DE | 29718052 U1 | 12/1997 |
| FR | 894627 A | 12/1944 |

OTHER PUBLICATIONS

International Search Report for International Patent Application PCT/EP2006/007208, dated Oct. 30, 2006.

* cited by examiner

*Primary Examiner*—Frederick L Lagman
(74) *Attorney, Agent, or Firm*—Novak Druce + Quigg LLP

(57) ABSTRACT

A connecting profile is disclosed for interconnecting three sheet-pile wall components. The connecting profile has a basic body from which three identical lock profiles project in predetermined coupling directions. Each lock profile comprises a thumb strip with a central web on which is formed a thumb which extends transversely to the longitudinal direction of the central web. A curved finger strip points in the direction of the thumb strip and forms a lock inner chamber and defines a mouth opening for the lock of the sheet-pile wall component that is to be hooked in. The mouth opening and the lock inner chamber are designed in such a way that the lock of the sheet-pile wall component that is to be hooked into the lock profile can be pivoted in the lock profile by a pivot angle of at least 15 degrees.

17 Claims, 10 Drawing Sheets

CONNECTING PROFILE FOR INTERCONNECTING THREE SHEET PILE WALL COMPONENTS AND AN ARRANGEMENT OF SHEET PILE WALL COMPONENTS COMPRISING SUCH A CONNECTING PROFILE

CROSS-REFERENCE TO RELATED APPLICATIONS

The present application is a continuation application of International Application No. PCT/EP2006/007208 filed Jul. 21, 2006 which claims priority to German Application Nos. 102005037564.2 filed Aug. 9, 2005 and 102006000624.0 filed Jan. 2, 2006. Each of the above-identified applications is expressly incorporated herein by reference in their entireties.

FIELD

The invention relates to a connecting profile, which has a uniform cross section, and which serves to interconnect three sheet pile wall components, like three sheet piles. Furthermore, the invention relates to an arrangement of three sheet pile wall components. This arrangement comprises at least three sheet pile wall components, which are connected together by means of such a connecting profile.

BACKGROUND

When sheet pile walls are erected, a variety of sheet pile wall components—like sheet piles, carrier elements, and connecting profiles—are used. These various components are connected together. For this interconnection, the sheet piles and the connecting profiles and, if desired, also the carrier elements, are usually equipped with locks, which engage with each other.

If it is desired that three sheet pile wall sections are to be connected together, the above described connecting profile is used. To this end the connecting profile exhibits altogether three identical lock profiles, which protrude from the base body of the connecting profile in different predetermined coupling directions. In this case each lock profile exhibits a thumb strip and a curved finger strip, which is designed for hooking the sheet pile wall components. The lock of the sheet pile wall component, which is to be hooked, exhibits in an analogous manner a thumb strip and a curved finger strip.

In this context the coupling direction is defined as the direction, in which the hooked lock of the sheet pile and the lock profile of the connecting profile form, as viewed in the cross section, a so-called three point connection. Therefore, the thumb of the lock of the sheet pile wall component is accommodated in the lock chamber of the lock profile of the connecting profile, whereas the thumb of the connecting profile is accommodated in the lock chamber of the lock of the sheet pile wall component. If a tensile force acts on the sheet pile wall component in the coupling direction, the two thumbs brace each other, on the one hand, and, on the other hand, brace themselves against the finger strips of the respective other lock, so that, when seen in the cross section, the two locks rest against each other or are mutually braced at three points.

Profiles are disclosed in U.S. Pat. No. 3,688,508 and DE 3907348 A1, but they are no longer used or have never been used.

The connecting profile disclosed in the U.S. Pat. No. 3,688,508 had the problem that the connecting profile did not allow for any relative movements between the lock profiles and the locks of the sheet pile wall components, with the result that, when the sheet pile wall components were rammed into the ground, the engaging locks were heated due to the frictional forces, acting between the locks, to such an extent that they were welded together; and in the worst case the locks even broke away.

In contrast, the connecting profile disclosed in the DE 39 07 348 A1 was never used because the connecting profile cannot be manufactured in the described design with a channel extending in the longitudinal direction in the base body.

An object of the present invention is to provide a connecting profile for interconnecting three sheet pile wall components and/or an arrangement of three sheet pile wall components, which are to be connected together by means of such a connecting profile and with which it is possible, in particular, to erect sheet pile walls without any problems.

SUMMARY

The above object is achieved with a connecting profile of uniform cross section for interconnecting three sheet pile wall components such as three sheet piles. The connecting profile has a base body from which three identical lock profiles project in the predetermined directions for hooking the sheet pile wall components. Each lock profile exhibits a thumb strip with a central web on which is molded a thumb and which runs at right angles to the longitudinal direction of said central web and projects beyond the central web. Additionally, each lock profile has a curved finger strip which points with its free end in the direction of the thumb strip, and forms with the latter a lock inner chamber, which is at least approximately elliptical or oval in cross section, and is characterized by the ends of the thumbs pointing in the direction of the finger strip. The connecting profile further includes a mouth opening for the lock of the sheet pile wall component that is to be hooked in, wherein the mouth opening and the lock inner chamber are designed in such a manner that the lock of the sheet pile wall component, which is to be hooked into the lock profile of the connecting profile, can be swiveled in the lock profile at a swivel angle of at least 15 degrees.

Furthermore, the object is achieved with an arrangement of three sheet pile wall components—such as three sheet piles or two sheet piles and a carrier element—which are connected together by means of a connecting profile. The arrangement can be like the one described above.

With the connecting profile designed according to the invention, an object is achieved in which the sheet pile wall components—for example, sheet piles which are hooked into the lock profiles of the connecting profile are accommodated in the lock chambers of the lock profiles of the connecting profile in such a manner that they can move relatively freely. Therefore, when the sheet pile wall components are rammed into the earth, it is very difficult for the locks of the sheet pile wall components to tilt in the lock profiles of the connecting profile. Since even when sheet pile wall components are rammed into the earth with the greatest of care, the ubiquitous non-homogeneity of the earth—for example, cliffs or layers of gravel—can cause the sheet pile wall components to yield, twist or deflect. The inventive connecting profile makes it possible, nevertheless, to make a reliable connection owing to the given capability of the locks of the sheet pile wall components to swivel in the lock chambers. Furthermore, inaccuracy in the run of the three sheet pile walls, which can be connected together by means of the connecting profile, can be compensated.

Other advantages of the invention are disclosed in the following description, the drawings and the claims.

Therefore, a preferred embodiment, of the inventive connecting profile proposes that at least one of the lock profiles is inclined, as seen in the cross section, in relation to its predetermined coupling direction in such a manner that the lock of the sheet pile wall component that is to be hooked into the lock profile can be swiveled with its main direction of the application of force in a swivel range of at least ±8 degrees to ±12 degrees about the predetermined coupling direction. Thus, it has been demonstrated that in the case of a lock profile, which is formed by a thumb strip and a finger strip and which is oriented on the base body exactly in relation to the predetermined coupling direction, a swivel movement of the sheet pile wall component from the predetermined coupling direction in the direction of the thumb strip is limited, whereas a swivel movement of the sheet pile wall component starting from the predetermined coupling direction into the opposite swivel direction by a multiple is possible. Since the lock profile is formed on the base body so as to tilt with respect to the predetermined coupling direction, the object is achieved that the sheet pile wall component with its lock can be swiveled in the lock profile of the inventive connecting profile in relation to the predetermined coupling direction in both possible swivel directions by at least approximately the same maximum swivel angle.

In a preferred further development of this embodiment the lock profile runs with the main axis of its lock inner chamber, which is elliptical or oval in cross section, at an angle of inclination ranging from 5 degrees to 10 degrees with respect to its predetermined coupling direction. Therefore, its thumb strip tilts away from the predetermined coupling direction. Insofar as the lock profile runs at such an angle of inclination in relation to the base body, it is possible to swivel the sheet pile wall component by approximately the same swivel angle in relation to the predetermined coupling direction in both directions. In this case an angle of inclination ranging from 7 degrees to 8 degree for the lock profile has proved to be especially advantageous.

In order to be able to swivel all of the sheet pile wall components in relation to the predetermined coupling directions in opposite directions by at least approximately the same swivel angle, it has been proposed that all lock profiles run at an angle of inclination ranging from 5 degrees to 10 degrees in relation to the respective predetermined coupling directions.

Thus, in both lock profiles, the thumb strips of which are formed directly adjacent to each other on the base body, tilt towards one another.

In a preferred embodiment, in which the directions of attack are offset by 120 degrees respectively, the operating point of each lock profile, on which the resulting tensile force act at a hooked sheet pile wall component running in the coupling direction, exhibits the same radial distance from the planar center of mass of the connecting profile as the operating points of the two other lock profiles. This design of the connecting profile, in which the operating points exhibit the same radial distance from the planar center of mass of the connecting profile, achieves, on the one hand, that the tensile forces, attacking the connecting profiles due to the hooked sheet pile wall sections, attack in a uniformly distributed manner at the connecting profile and, thus cancel each other out at least to some degree. On the other hand, the installation position of the connecting profile is irrelevant. Thus, the connecting profile can be rammed into the ground with either one or the other face side. Furthermore, it is irrelevant which sheet pile wall component engages with which lock profile of the connecting profile. In this context it has been demonstrated in the past that the use of non-symmetrical connecting profiles for connecting three sheet pile wall sections always presents a problem, because at construction sites the connecting profiles are frequently rammed into the ground without checking the correct installation position. However, when the non-symmetrical connecting profiles are installed in an incorrect position, the run of the sheet pile wall sections in relation to each other does not meet the building specifications, so that the forces attacking the sheet pile wall sections are transferred non-uniformly to the connecting profile. Or the sheet pile wall components cannot be built, or can be built only with difficulty, in the desired installation position.

If, however, the installation position does not present a problem, it is also possible to use connecting profiles, in which the lock profiles, the thumb strips of which are designed on the base body directly adjacent to each other, exhibit a longer distance from the planar center of mass of the connecting profile than the other of the three lock profiles. This measure achieves the goal that the sheet pile wall components, which are hooked into the lock profiles having thumb strips that are configured directly adjacent to each other, have sufficient space to swivel and do not collide with the base body of the connecting profile.

In order for the locks of the sheet pile wall components to have adequate free space to swivel inside the lock profiles of the inventive connecting profile, the ratio between the opening width of the mouth opening of each lock profile and the maximum opening width of the lock inner chamber of the effective lock profile is in a range of 1 to 2 up to 1 to 2.5 in a preferred further development of the inventive connecting profile. In this context it is also advantageous if for each lock profile of the inventive connecting profile the ratio between the length of the thumb, as seen at right angles to the longitudinal direction of the central web, and the maximum opening width of the lock inner chamber is in a range of 1 to 1.2 up to 1 to 1.4. A corresponding design of the thumb guarantees, on the one hand, that the lock of the sheet pile wall component has adequate capacity to swivel in the lock inner chamber, whereas it is guaranteed, on the other hand, that the lock can adequately interlock with the lock profile, thus avoiding an unintentional detachment of the engaging locks.

In addition, in order to improve the swivel capability of the sheet pile wall components, a further development of the inventive connecting profile proposes that the central web of the thumb strip be designed in such a manner that the ratio between the thickness of the central web, as seen at right angles to its longitudinal direction, and the opening width of the mouth opening is in a range of 1 to 1.2 up to 1 to 1.4.

The three above described design features—that is, the ratio between the opening width of the mouth opening and the opening width of the lock chamber, the ratio between the length of the thumb and the opening width of the lock inner chamber, as well as the ratio between the thickness of the central web and the opening width of the mouth opening—can be realized individually or also partially with respect to at least one of the lock profiles as a function of the application purpose.

In order to guarantee that the forces that are applied to the lock profiles and that can frequently amount to several thousand kilonewtons do not result in the lock profile being damaged, it is also proposed that for each lock profile of the inventive connecting profile that the ratio between the thickness of the central web, as seen at right angles to its longitudinal direction, and the length of the thumb, as seen at right angles to the longitudinal direction of the central web, is in a range of at least 1 to 2.3 up to 1 to 2.5. Thus, it is precisely the length of the thumb that is relevant for the swivel capability of the lock of the sheet pile wall component because the lock is swiveled about the thumb of the thumb strip. The lock engages, in particular, with the thumb of the thumb strip. Furthermore, the lock has to partially envelop this thumb so that a secure hold in the lock inner chamber is guaranteed. The result is that the width of the central web, to which the thumb is molded, has to be dimensioned in such a manner that the lock can be swiveled, on the one hand, in the lock inner chamber without any hindrance. On the other hand, the strength of the thumb strip must be sufficiently high that the thumb strip is prevented from deforming or being torn out.

In order to give sufficient strength to the lock profiles of the inventive connecting profile, it is also proposed that the wall thickness of the curved finger strip of each lock profile in the area of the maximum opening width of the lock inner chamber is designed larger by a factor ranging from 1.1 to 1.3 than the thickness of the central web, as seen at right angles to its longitudinal direction, in the area of the maximum opening width of the lock inner chamber.

In a preferred embodiment of the inventive connecting profile, the three coupling directions of the three lock profiles are offset by 120 degrees in relation to each other so that the sheet pile wall sections which are offset by an angle of approximately 120 degrees in relation to each other and run towards the connecting profile may be connected together. However, it is also conceivable that the inventive connecting profile is designed in such a manner that, for example, two of the lock profiles project—thus, are offset by 180 degrees in relation to each other—from the base body in opposite coupling directions, whereas the third lock profile runs, for example, at an angle of 90 degrees in relation to the two other lock profiles.

The base body of the inventive connecting profile may be designed in the shape of a cylinder from which the lock profiles project outwards in the radial direction into the various coupling directions. However, as an alternative it is also possible to design the base body in the shape of a star. That is, the base body exhibits webs, which project in the manner of a star into the three coupling directions and on the ends of said webs the lock profiles are molded. A connecting profile, which is designed in the above described manner, is especially suitable, for example, for bridging longer distances between the individual sheet pile wall components which are to be connected together.

According to a second aspect, the invention relates to an arrangement of three sheet pile wall components—like three sheet piles or two sheet piles and a carrier element—which are connected together by means of the inventive connecting profile.

Hence, in a preferred configuration, two of the sheet pile wall components, which are coupled to the lock profiles of the connecting profile and the thumbs of said lock profiles, are formed on the base body directly adjacent to each other and are constructed as the sheet piles and are coupled to the other sheet piles while simultaneously forming a sheet pile wall section that has the shape of a circular segment or a polygon.

On the other hand, the third sheet pile wall component, which engages with the third lock profile of the inventive connecting profile, serves as the anchoring mechanism for the connecting profile and to brace the connecting profile.

The last sheet pile wall component may be designed either as a carrier element—for example, a double T-shaped carrier, a tubular pile or the like. As an alternative, it is also possible to design the sheet pile wall component as a sheet pile, which is coupled to a carrier element either directly or indirectly via other sheet piles, engaging with the sheet pile.

BRIEF DESCRIPTION OF THE DRAWINGS

The invention is explained in detail below by means of an embodiment as well as variants of said embodiment with reference to the drawings.

DETAILED DESCRIPTION

Figure 1:
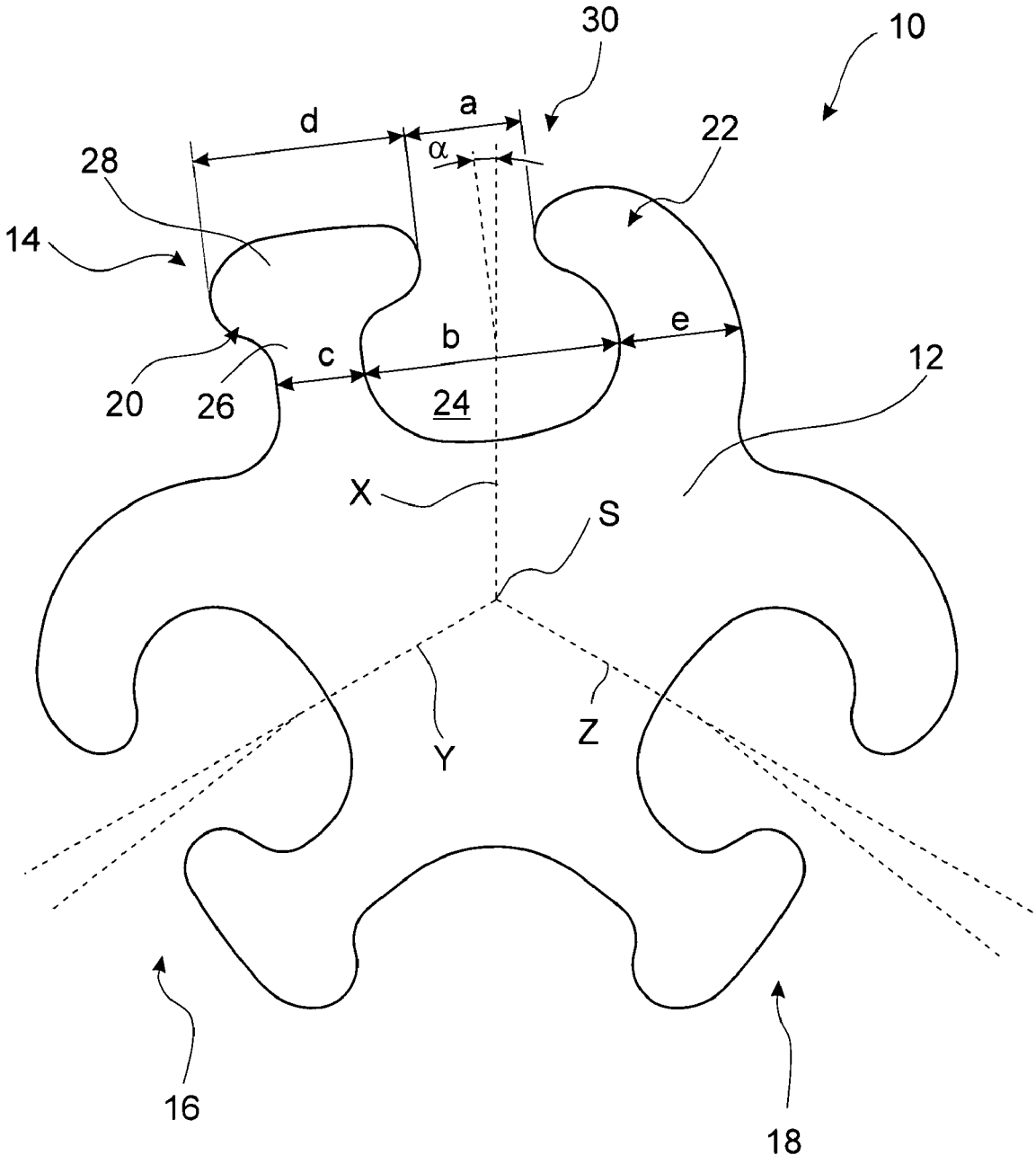
FIG. 1 is a top view of the face side of an embodiment of an inventive connecting profile comprising three lock profiles, the coupling directions of which are offset by 120 degrees in relation to each other and are outwardly oriented in the radial direction.
Figure 2:
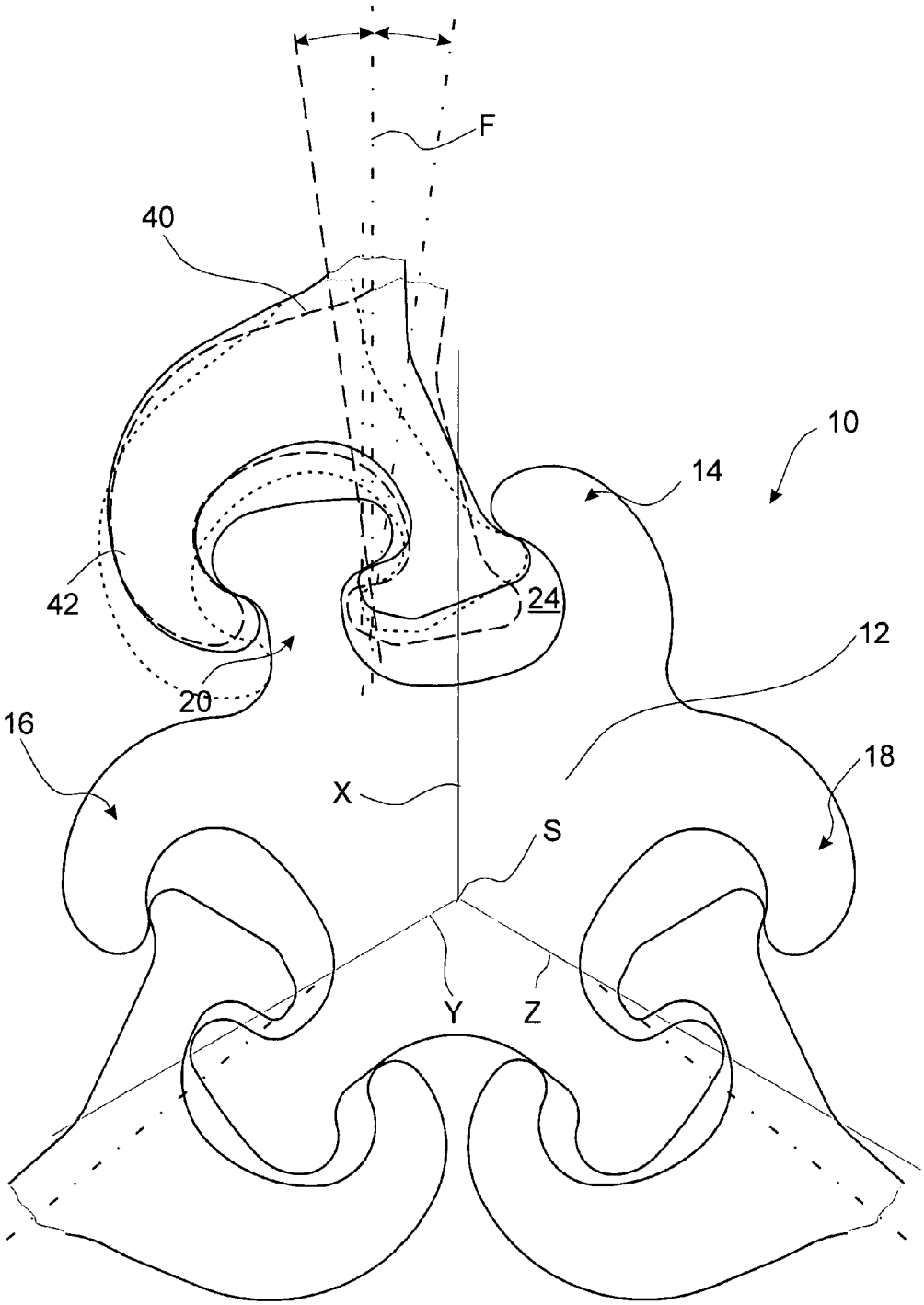
FIG. 2 is a top view of the connecting profile shown in FIG. 1 and into which a total of three flat profiles are hooked as the sheet pile wall components.

FIGS. 1 and 2 are a top view of an embodiment of an inventive connecting profile 10 which has a cross section that is constant over its entire length. The connecting profile 10 serves to interconnect three sheet pile wall components—for example, sheet piles which run towards one another from different directions. The connecting profile 10, which is depicted in FIGS. 1 and 2, has three predetermined coupling directions X, Y and Z which are offset by 120 degrees in relation to each other. In this context the coupling direction X, Y or Z is defined as the direction in which the hooked sheet pile wall component forms with the connecting profile as seen in the cross section, a so-called three point connection.

The connecting profile 10 has a base body 12, of which three lock profiles 14, 16, and 18 project into the three coupling directions X, Y, and Z. Since the lock profiles 14, 16 and 18 are identical in design, the following discussion shall refer to FIG. 1 with respect to the construction of the lock profiles 14, 16 and 18 that are explained in detail below by means of the lock profile 14, depicted in FIG. 1.

The lock profile 14 has a thumb strip 20 as well as a finger strip 22, which is spaced apart from the thumb strip. Both the thumb strip and the finger strip project jointly from the base body 12 and partially enclose a lock inner chamber 24.

The thumb strip 20 is formed by a central web 26 which extends from the base body 12. The free end of the central web has a thumb 28 which runs at right angles to the longitudinal direction and which extends beyond the central web 26 in both directions.

The finger strip 22 also extends from the base body 12 and runs in the shape of a curve into the thumb strip 20. In so doing, the finger strip 22 and the outer surface of the thumb 28 end in a tangential plane (not illustrated) and define, together with the end of the thumb 28 pointing in the direction of the finger strip 22, a mouth opening 30.

The transition of the base body 12 into the central web 26, the transition of the central web 22 into the thumb 28 and the transition of the base body 12 into the finger strip 22 are rounded off. Their contour is adapted to the contour of an ellipse in such a manner that the lock inner chamber 24 exhibits an inner cross section that is at least approximately elliptical.

In the case of the connecting profile 10 the sheet pile wall components, which are to be hooked, their locks may be swiveled in a defined manner in the lock inner chambers 24 of the lock profiles 14, 16 and 18. Therefore, in each swivel position of the sheet pile wall component it is still guaranteed that the lock of the sheet pile wall component will be held securely in the lock inner chamber 24 of the connecting profile 10.

In order to simplify the swiveling motion, the following design features are also proposed for the inventive connecting profile 10. First, the ratio between the opening width (a) of the mouth opening 30 and the maximum opening width (b) of the lock inner chamber 24 is approximately 1 to 2.1. The ratio of the thickness (c) of the central web 26, as viewed at right angles to its longitudinal direction, and the opening width (a) of the mouth opening 30 is in turn 1 to 1.3. The ratio between the thickness (c) of the central web 26, as viewed at right angles to its longitudinal direction, and the length (d) of the thumb 28, as viewed at right angles to the longitudinal direction of the central web 26, is 1 to 2.3 Furthermore, the ratio of the length (d) of the thumb 28, as viewed at right angles to the central web 26, and the maximum opening width (b) of the lock inner chamber 24 is 1 to 1.25.

These design features guarantee that the lock of the sheet pile wall component stays swivelable in a swivel range of approximately 16 degrees without the lock of the sheet pile wall component jumping out of the lock profile 14, 16 and/or 18 of the connecting profile 10.

Nevertheless, in order to guarantee that the lock profile 14, 16 and/or 18 can oppose the generated holding forces despite the swivel capability of the sheet pile wall component and not break away, the strips 20 and 22, which form the lock profile 14, 16 and/or 18, are dimensioned to match.

Therefore, in the region of the maximum opening width (b) of the lock inner chamber 24 the wall thickness (e) of the curved finger strip 22 of each lock profile 14, 16 and 18 is greater by a factor of 1.2 than the thickness (c) of the central web 26, as viewed at right angles to its longitudinal direction, in the region of the maximum opening width (b) of the lock inner chamber 34. Since the thumb strip 20 experiences a share of the tensile force, which acts along the longitudinal direction of the central web 26 and is very high compared to the share of the shear force, the central web 26 of the thumb strip 20 may be designed weaker than the finger strip 22. In contrast, the finger strip 22 experiences a higher share of the attacking shear force, so that, in particular, the finger strip 22 is attacked by a comparatively high bending moment, which has to be absorbed by the finger strip 22.

In order for the sheet pile wall components to be capable of swiveling by at least approximately the same angle with respect to the respective coupling direction X, Y and Z, the three lock profiles 14, 16 and 18 in turn are formed on the base body 12 so as to tilt with respect to the coupling directions X, Y and X (to be explained below).

Thus, the lock profile 14, which is depicted above in FIG. 1, is tilted by the angle $\alpha$, which in this case is 7.5 degrees, with respect to the coupling direction X. Therefore, the thumb strip 22 is tilted away from the coupling direction X.

The two other lock profiles 16 and 18 are also formed on the base body 12 so as to tilt by 7.5 degrees towards the respective coupling direction Y or Z. In this case, too the thumb strips 22 also tilt away from the coupling directions Y and Z.

Since the two lock profiles 16 and 18, depicted at the bottom in FIG. 1, are configured closer to each other owing to their sloped contour, the distance between the two lock profiles 16 and 18 and the planar center of mass S of the connecting profile 10 is greater than the distance from the lock profile 14, depicted at the top. This feature guarantees that the sheet pile wall components, which are hooked into the two lock profiles 16 and 18 at a later point in time, do not touch each other, even if they are moved by the maximum amount towards each other.

FIG. 2 depicts the inventive connecting profile 10. So-called union flat profiles 40 with their locks 42 are hooked in the lock profiles 14, 16 and 18 as the sheet pile wall components. Hence, FIG. 2 shows in the lock profile 14, depicted at the top, the swivel range, within which the flat profile 40 can be swiveled with respect to the connecting profile 10. The example shows that starting from a base position (indicated by the solid line) in which the flat profile 40 with its main direction of the application of force F runs parallel to the coupling direction X and the engaging locks 14 and 42 rest, as seen in the cross section, against each other at three points, the flat profile 40 may be hooked into the connecting profile 10 so as to swivel by an angle of approximately 8.5 degrees respectively between a first end position and a second end position (both indicated by dashed lines), so that the swivel range is ±8.5 degrees.

In the two other lock profiles 16 and 18 the two flat profiles 40 are shown in their end positions in which they are swiveled towards one another in order to illustrate that the flat profiles 40 do not touch even in this extreme position.

Figure 3:
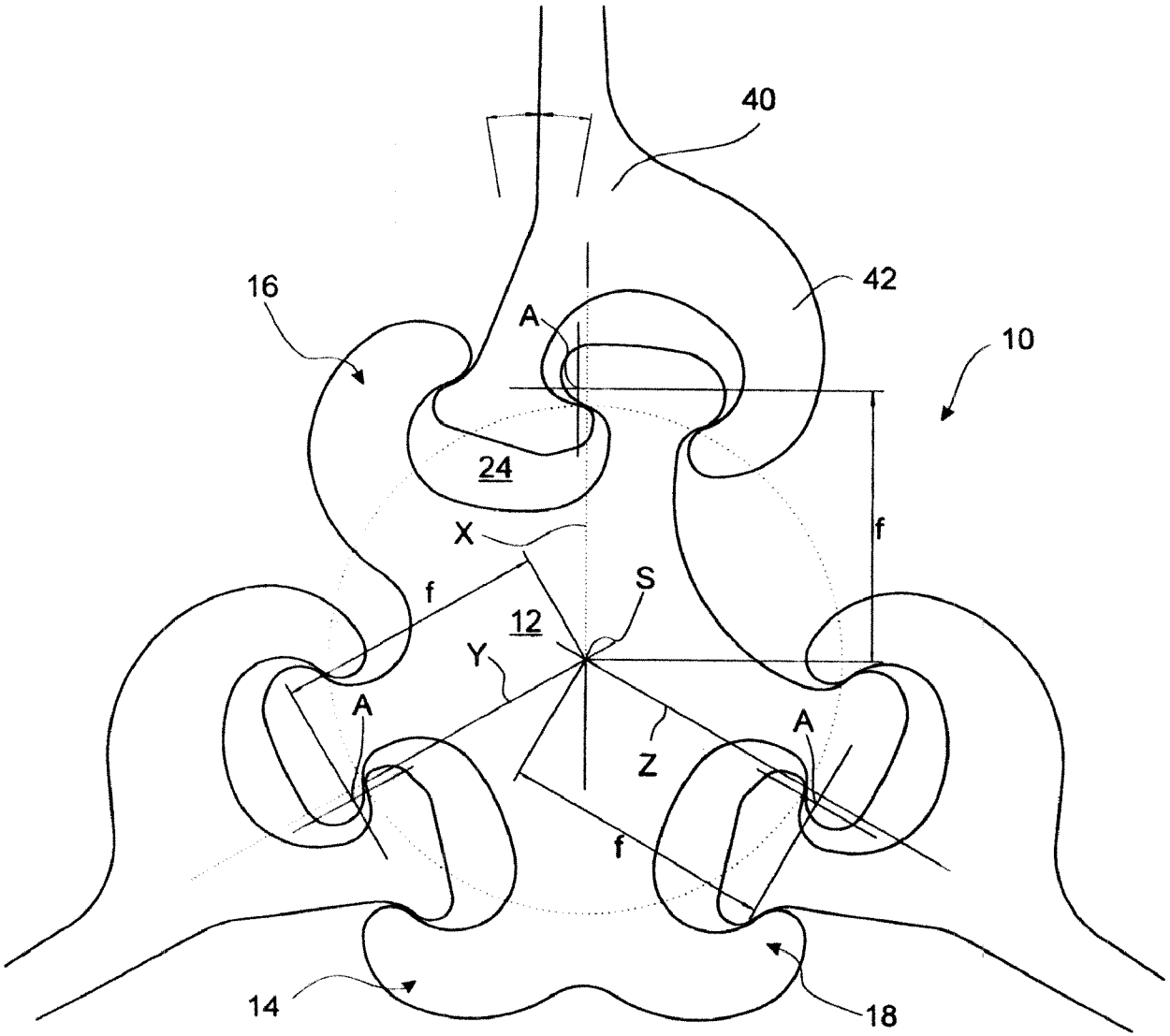
FIG. 3 is a top view of the face side of a first variant of the embodiment depicted in FIGS. 1 and 2 and in which the operating points of the lock profiles are the same radial distance from the planar center of mass.

FIG. 3 depicts a first variant of the connecting profile 10 which is depicted in the FIGS. 1 and 2. In this modified connecting profile 10*a*, the lock profiles 14*a*, 16*a* and 18*a* are also formed on the base body 12*a* so as to be offset by 120 degrees to one another. A feature of this connecting profile 10*a* is that the operating point A of each lock profile 14*a*, 16*a* and/or 18*a* at which the resulting tensile force acts at the hooked sheet pile wall components 40 running in the coupling direction X, Y and/or Z exhibits the same radial distance F from the planar center of mass S of the connecting profile 10*a* as the operating points A of the two other lock profiles 16*a*, 18*a* and/or 14*a*. This design of the connecting profile 10*a*, where the operating points A exhibit the same radial distance from the planar center of mass S of the connecting profile 10*a*, achieves the goal that the tensile forces, attacking at the connecting profile 10*a* due to the hooked sheet pile wall components 40, attack in a uniformly distributed manner the connecting profile 10*a*. Thus, these forces cancel each other out at least to some degree. In addition, this feature achieves the goal that the installation position of the connecting profile 10*a* is variable, so that the connecting profile 10*a* can be installed in any position without having to pay attention to the run of the lock profiles 14*a*, 16*a*, and 18*a* when hooking the sheet pile wall components 40.

Figure 4:
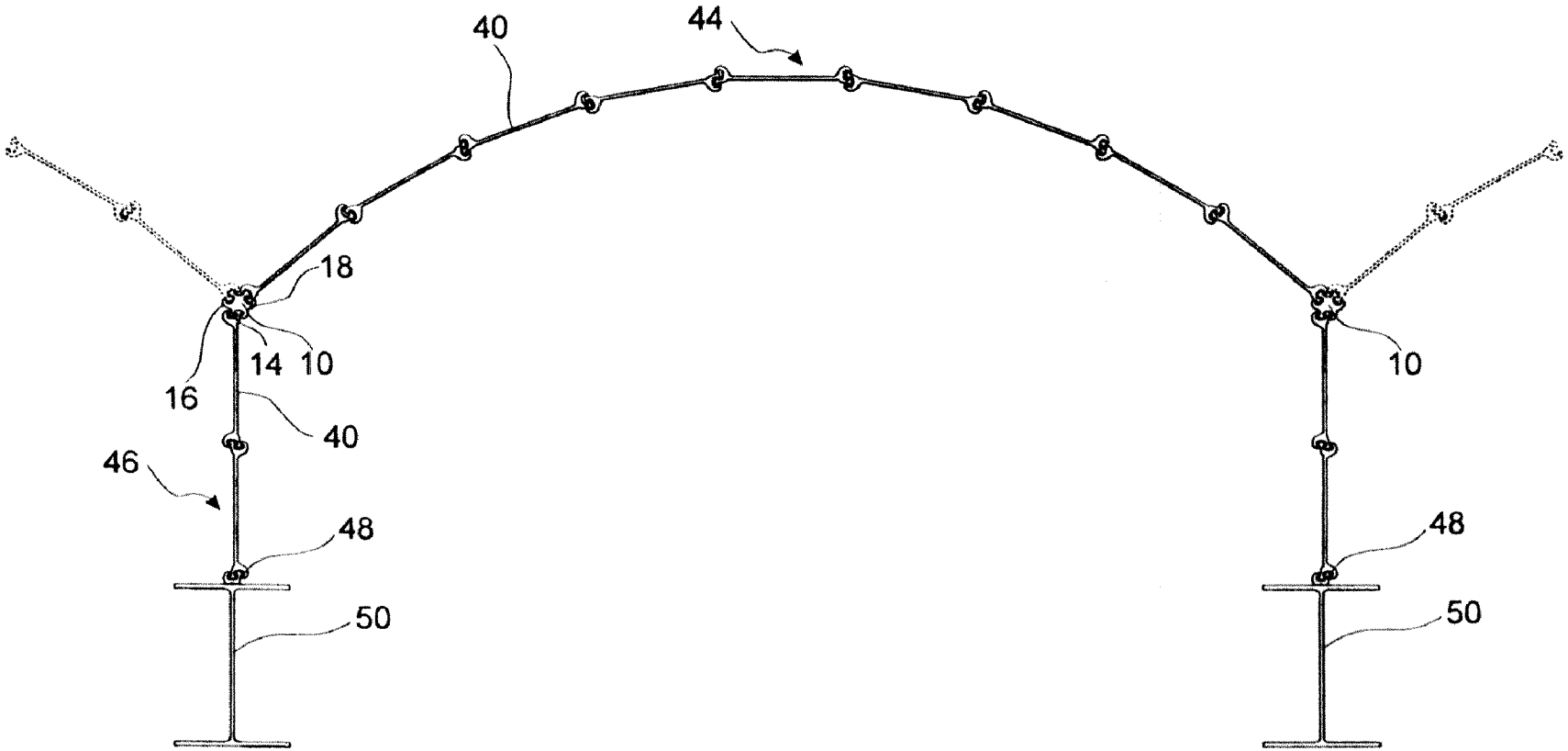
FIG. 4 is a top view of an arrangement comprising three sheet pile walls which are coupled together by means of the inventive connecting profile.

FIG. 4 depicts an arrangement, comprising a total of nine flat profiles 40, which are hooked together to form a sheet pile wall section 44, which has the shape of a circular segment. The last two flat profiles 40 of the sheet pile wall section 44, which are disposed on the opposite ends, are hooked into the lock profiles 16 and/or 18 of two inventive connecting profiles 10. In an analogous manner additional sheet pile wall sections (indicated by a dashed line) which exhibit the shape of a circular segment are hooked into the respective other lock profiles 18 and/or 16 of the two connecting profiles 10.

The third lock profile 14 of each connecting profile 10 engages with an additional sheet pile wall section 46 comprising flat profiles 40. This additional sheet pile wall section is connected to a double T-shaped carrier 50 by means of a welding profile 48.

The inventive connecting profile 10 can compensate, as rendered graphically in the arrangement in FIG. 4, for any variations in the run of the sheet pile wall components. This feature is especially important in the case of a plurality of sheet pile wall sections which are to be coupled together at a common point.

FIGS. 5 to 10 depict additional variants of the connecting profile 10. In this case the base body 12 comprises, for example, web strips, which exhibit the shape of a star. The lock profiles 14, 16 and 18 are molded on the free ends of the web strips. However, it must be pointed out that all of the illustrated variants exhibit in a suitably adapted manner the design features relating to the opening width (a) of the mouth opening 30, the opening width b of the lock inner chamber 24, the width (c) of the central web 26, the length (d) of the thumb as well as the wall thickness (e) of the finger strip 22. In the illustrated variants the lock profiles 14, 16 and 18 do not tilt towards the coupling directions X, Y and Z, but rather are formed in such a manner that the lock inner chamber 24 runs with its maximum opening width (b) at least approximately at right angles to the respective coupling direction X, Y, and Z.

However, it must be pointed out that even in these variants at least one of the lock profiles 14, 16 and 18 tilts with respect to the coupling directions X, Y and Z, as described above with reference to FIGS. 1 and 2.

Figure 5:
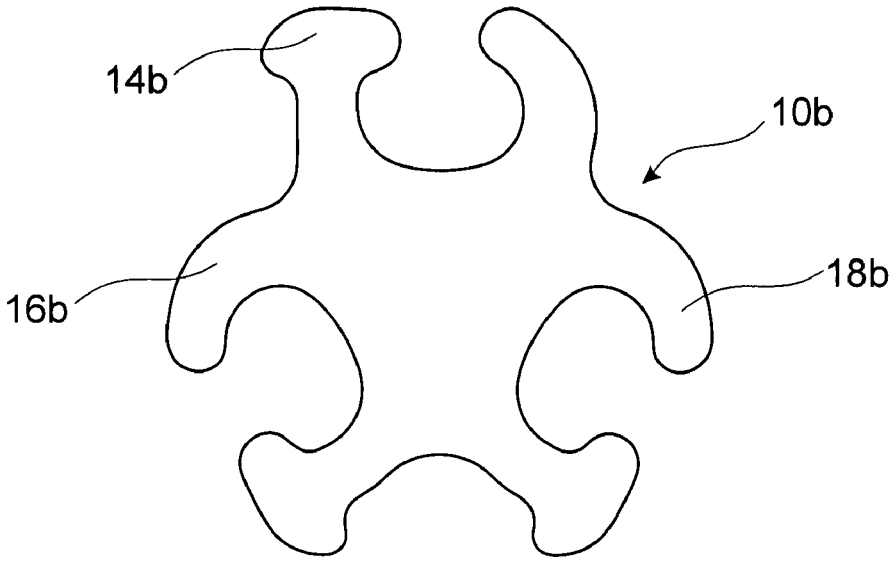
FIG. 5 is a top view of a second variant of the inventive connecting profile in which the lock profiles do not tilt towards the coupling directions.

Therefore, FIG. 5 shows a second variant 10*b* of the inventive connecting profile. In this case the lock profiles 14*b*, 16*b* and 18*b* do not tilt towards the coupling directions X, Y and Z.

Figure 6:
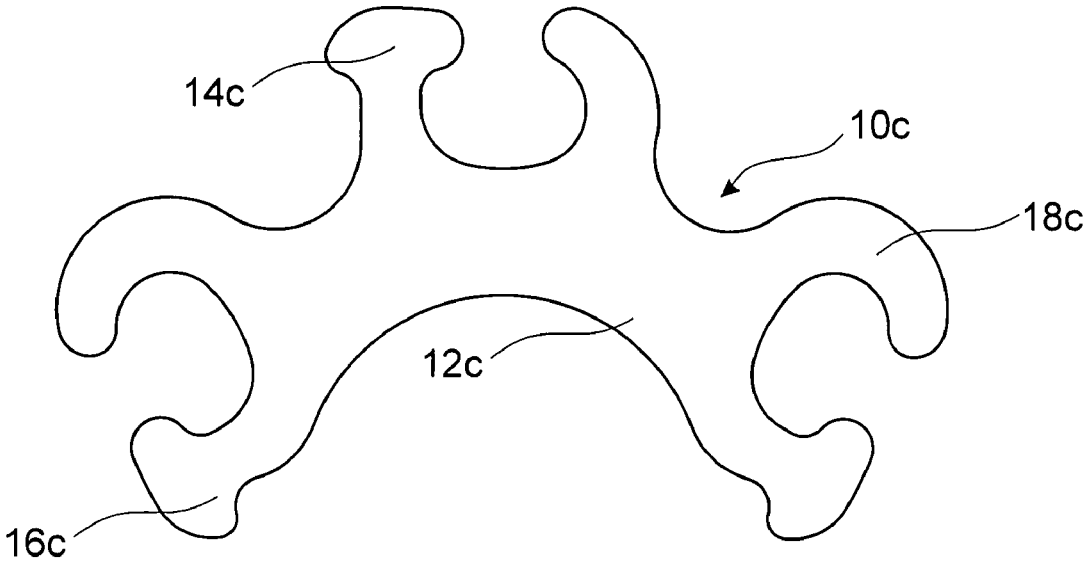
FIG. 6 is a top view of a third variant of the inventive connecting profile in which the base body is elongated in the shape of a curve and the two lock profiles and the thumb strips of which face each other and are formed on the ends of the curved base body.

FIG. 6 depicts a third variant 10*c* of the inventive connecting profile 10. In this case the base body 12*c* is elongated in the shape of a curve and the two lock profiles 16*c* and 18*c* are formed on the ends of the curved base body 12*c*. In contrast, the third lock profile 14*c* is formed in the middle of the curved base body 12*c*.

Figure 7:
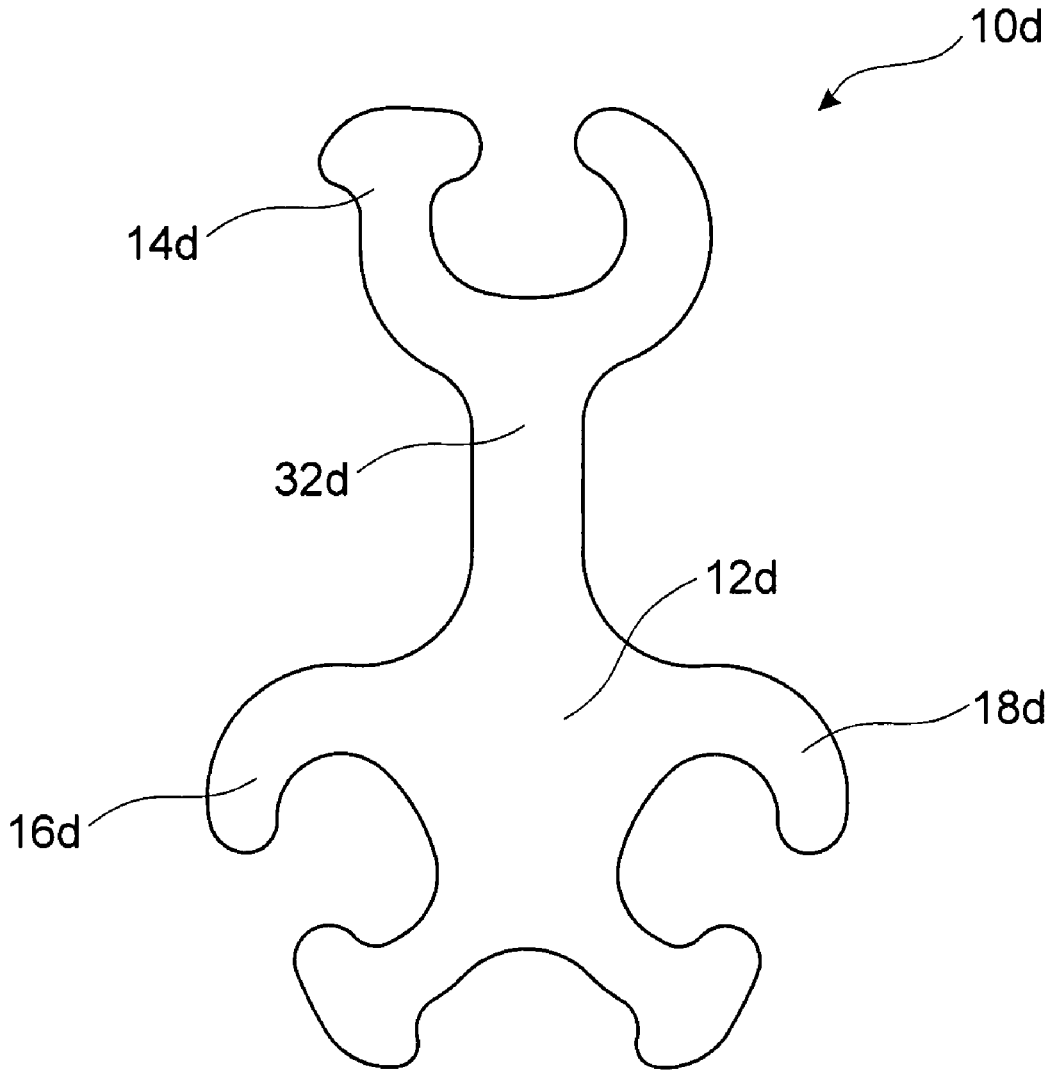
FIG. 7 is a top view of a fourth variant of the inventive connecting profile in which the base body exhibits a web strip and on the end of which one of the lock profiles is formed.

FIG. 7 is a top view of a fourth variant 10*d* of the inventive connecting profile 10. In this case the base body 12*d* exhibits a web strip 32*d* on the end of which one of the lock profiles 14*d* is formed.

Figure 8:
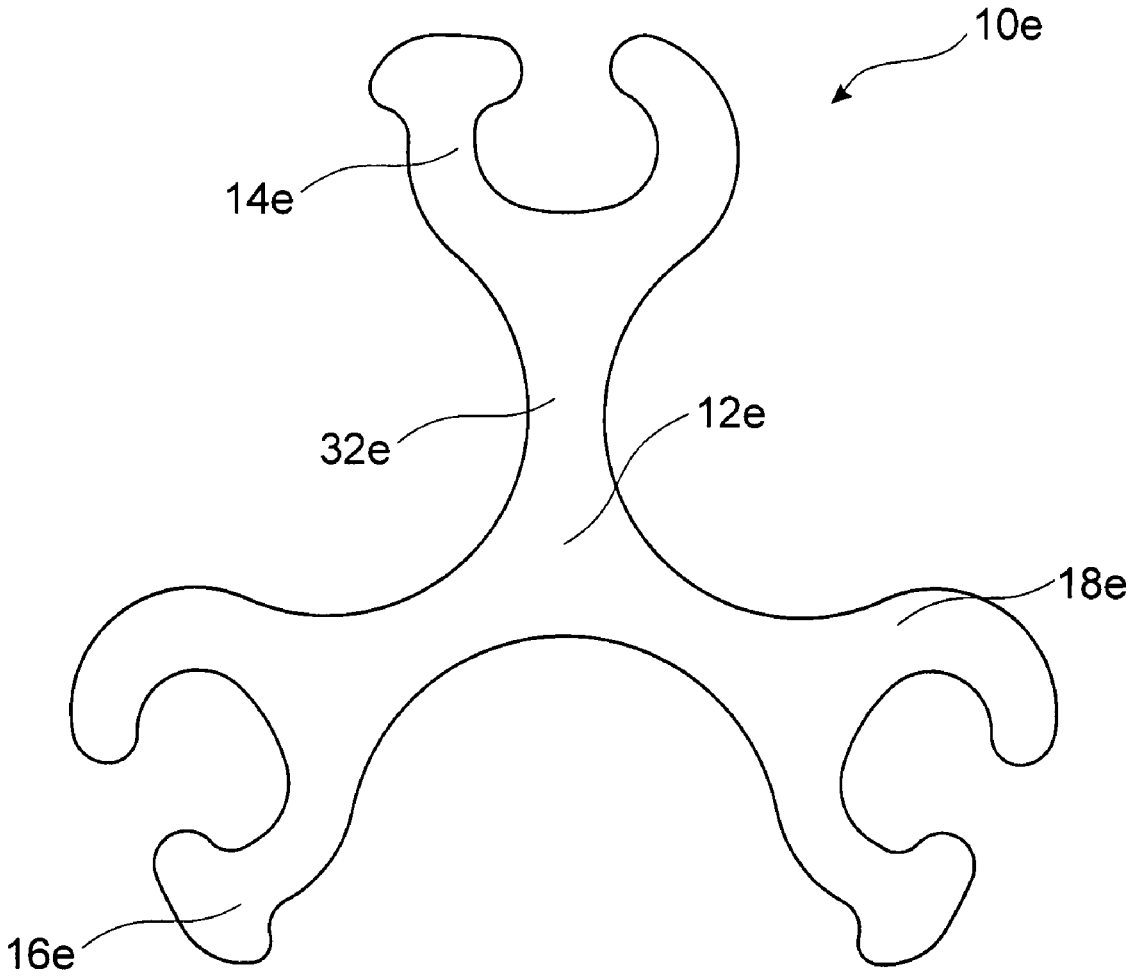
FIG. 8 is a top view of a fifth variant of the inventive connecting profile, in which the base body exhibits three web strips, which are rounded off and have the shape of a star and on the ends of which the lock profiles are formed.

FIG. 8 is a top view of a fifth variant 10*e* of the inventive connecting profile 10. In this case the base body 12*e* exhibits three web strips 32*e* which are rounded off and have the shape of a star. The lock profiles 14*e*, 16*e* and 18*e* are formed on the ends of said web strips. Since the web strips 32*e* have a rounded off contour, the goal is achieved that it is easier to deflect the stresses, attacking at the lock profiles 14*e*, 16*e*, and 18*e*.

Figure 9:
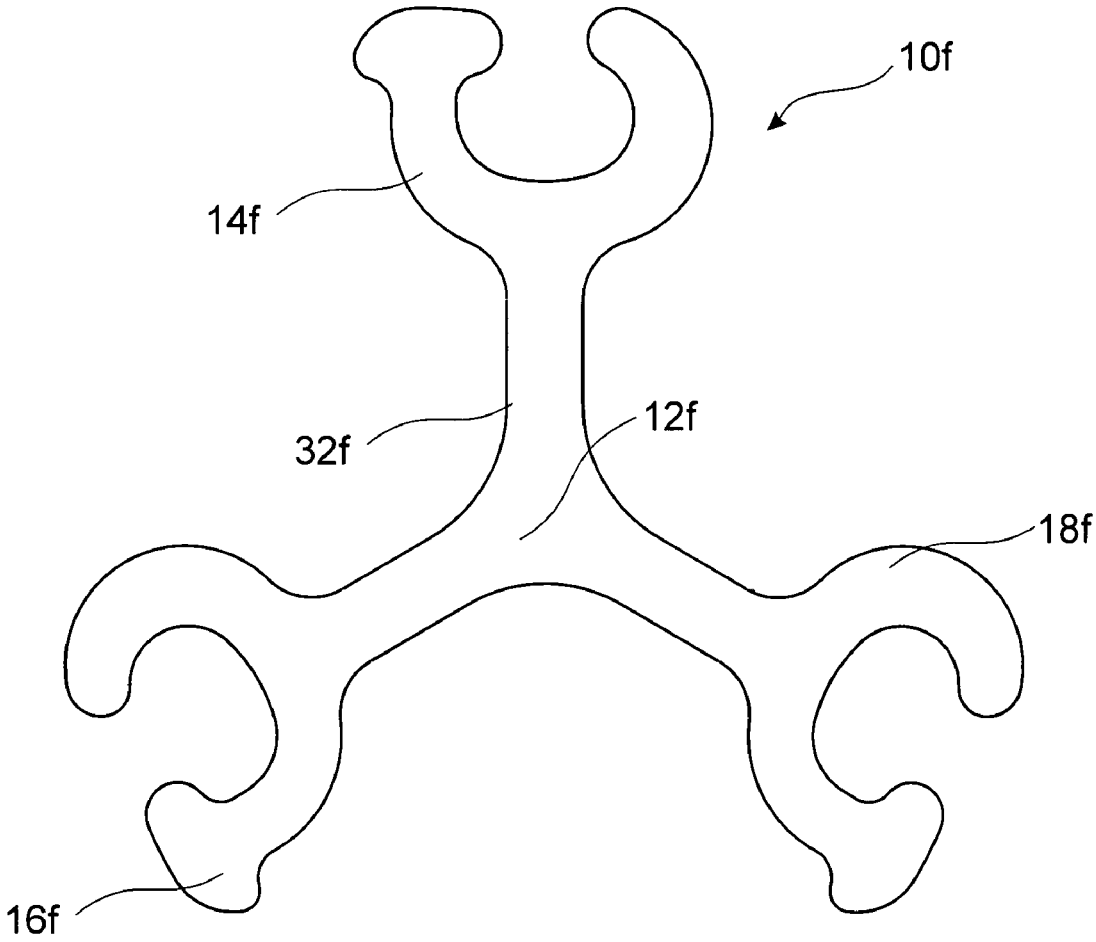
FIG. 9 is a top view of a sixth variant of the inventive connecting profile in which the base body exhibits three straight web strips which have the shape of a star and on the ends of which the lock profiles are formed.

FIG. 9 is a top view of a sixth variant 10*f* of the inventive connecting profile 10. In this case the base body 12*f* exhibits three straight web strips 32*f* which have the shape of a star. The lock profiles 14*f*, 16*f* and 18*f* are formed on the ends of said web strips.

Figure 10:
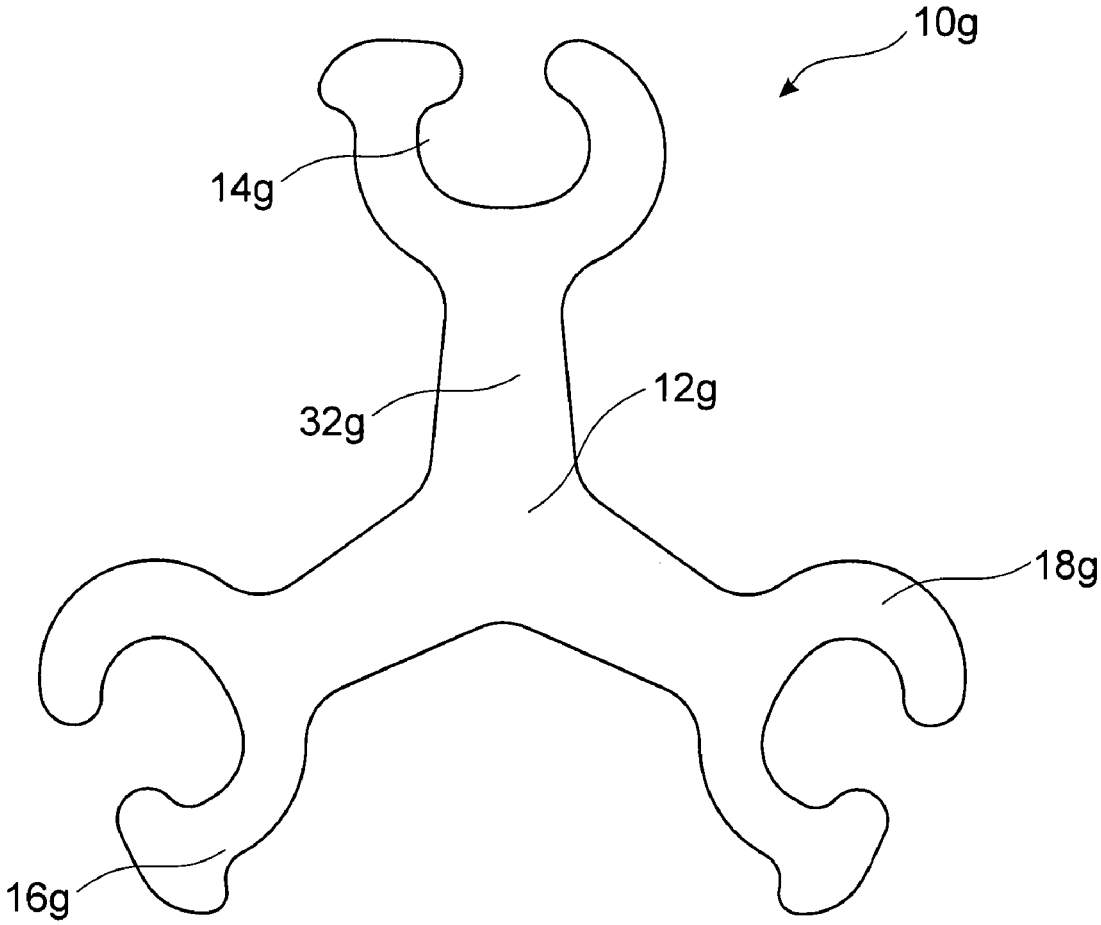
FIG. 10 is a top view of a seventh variant of the inventive connecting profile in which the base body exhibits three reinforced web strips and which have the shape of a star and on the ends of which the lock profiles are formed.

FIG. 10 is a top view of a seventh variant 10*g* of the inventive connecting profile 10. In this case, the base body 12*g* exhibits three reinforced web strips 32*g* which have the shape of a star. The lock profiles 14*g*, 16*g* and 18*g* are formed on the ends of said web strips. The reinforcement of the web strips 32*g* prevents the lock profiles 14*g*, 16*g*, and 18*g* from breaking out under extremely high tensile forces.

Figure 11:
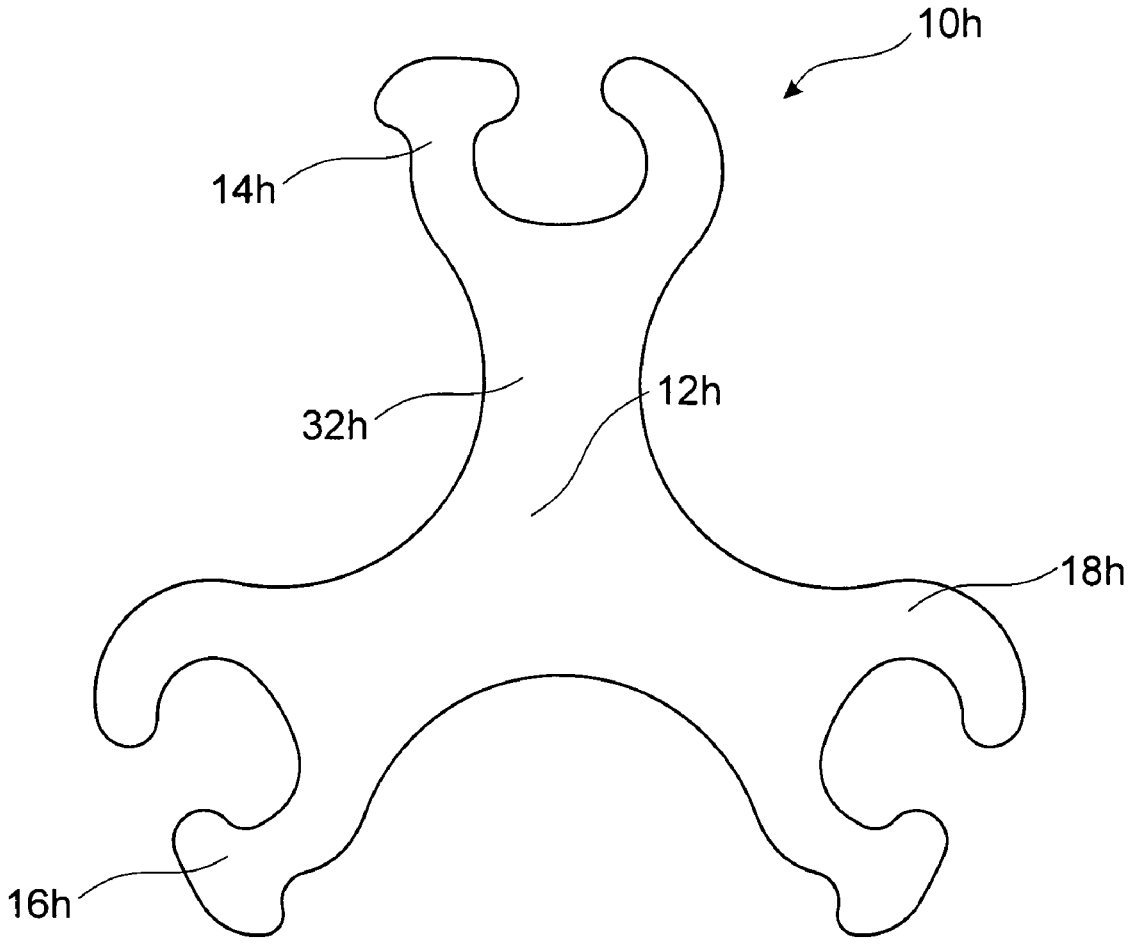
FIG. 11 is a top view of an eighth variant of the inventive connecting profile in which the base body exhibits three rounded off and reinforced web strips and which have the shape of a star and on the ends of which the lock profiles are formed.

Finally, FIG. 11 is a top view of an eighth variant 10*h* of the inventive connecting profile 10. In this case the base body 12*h* exhibits three rounded off and reinforced web strips 32*h* which have the shape of a star. The lock profiles 14*h*, 16*h* and 18*h* are formed on the ends of said web strips. In this case, too, the goal is to enhance the reduction in stress by means of the rounded off contouring.

The illustrated variants represent only a few of the possible designs. For example, the base body 12 may also be configured in such a manner that the lock profiles 14, 16 and 18 project in different coupling directions. What is relevant is that the lock profiles 14, 16 and 18 are designed in accordance with the invention.

What is claimed is:

1. A connecting profile having a uniform cross section for interconnecting three sheet pile wall components, comprising:

a base body, from which three substantially identical lock profiles project in predetermined directions for hooking sheet pile wall components, wherein each lock profile exhibits a thumb strip with a central web on which is molded a thumb; said thumb strip runs at right angles to the longitudinal direction of said central web and projects beyond the central web; wherein said curved finger strip points with its free end in the direction of the thumb strip and forms with the thumb strip a lock inner chamber; said lock inner chamber is at least approximately elliptical or oval in cross section, and said lock inner chamber defines with the ends of the thumbs pointing in the direction of the finger strip a mouth opening for the lock of the sheet pile wall component that is to be hooked in;

wherein at least one of the lock profiles is tilted, as viewed in the cross section, in relation to its predetermined coupling direction; and wherein the lock profile is tilted in such a manner that the lock of the sheet pile wall component that is to be hooked into the lock profile can be swiveled with its main direction of the application of force in a swivel range of at least ±8 degrees to ±12 degrees about the predetermined coupling direction.

2. The connecting profile as recited in claim 1, wherein the lock profile runs with a main axis of its lock inner chamber at an angle of inclination ranging from 5 to 10 degrees in relation to its predetermined coupling direction, whereby its thumb strip is tilted away from the predetermined coupling direction.

3. The connecting profile as recited in claim 1, wherein all lock profiles run at an angle of inclination ranging from 5 to 10 degrees with respect to the predetermined coupling directions, whereby both all lock profiles and the thumb strips which are formed on the base body directly adjacent to each other, tilt towards one another.

4. The connecting profile as recited in claim 1, wherein each lock profile has an operating point, on which the resulting tensile force acts at a hooked sheet pile wall component that runs in the coupling direction; and that the operating points of the lock profiles exhibit the same radial distance from the planar center of mass of the connecting profile.

5. The connecting profile as recited in claim 1, wherein the two lock profiles, the thumb strips of which are formed on the base body directly adjacent to each other, exhibit a longer distance from the planar center of mass of the connecting profile than the other of the three lock profiles.

6. The connecting profile as recited in claim 1, wherein the ratio between an opening width of the mouth opening and a maximum opening width of the lock inner chamber is in a range of 1 to 2 up to 1 to 2.5.

7. The connecting profile as recited in claim 1, wherein the ratio between a thickness of the central web, as seen at right angles to its longitudinal direction, and an opening width of the mouth opening is in a range of 1 to 1.2 up to 1 to 1.4.

8. The connecting profile as recited in claim 1, wherein the ratio between a thickness of the central web, as seen at right angles to its longitudinal direction, and a length of the thumb, as seen at right angles to the central web, is in a range of at least 1 to 2.3 up to 1 to 2.5.

9. The connecting profile as recited in claim 1, wherein the ratio between a length of the thumb, as seen at right angles to the longitudinal direction of the central web, and a maximum opening width of the lock inner chamber is in a range of 1 to 1.2 up to 1 to 1.4.

10. The connecting profile as recited in claim 1, wherein the wall thickness of the curved finger strip of each lock profile in an area of the maximum opening width of the lock inner chamber is larger by a factor ranging from 1.1 to 1.3 than the thickness of the central web, as seen at right angles to its longitudinal direction.

11. The connecting profile as recited in claim 1, wherein the three coupling directions of the three lock profiles are offset by 120 degrees in relation to each other.

12. The connecting profile as recited in claim 1, wherein the base body exhibits web strips, which project in the three different coupling directions, and on the ends of said webs the lock profiles are molded.

13. An arrangement of three sheet pile wall components which are connected together by means of a connecting profile, said arrangement comprising:

a base body, from which three substantially identical lock profiles project in predetermined directions for hooking sheet pile wall components, wherein each lock profile exhibits a thumb strip with a central web on which is molded a thumb; said thumb strip runs at right angles to the longitudinal direction of said central web and projects beyond the central web; wherein said curved finger strip points with its free end in the direction of the thumb strip and forms with the thumb strip a lock inner chamber; said lock inner chamber is at least approximately elliptical or oval in cross section, and said lock inner chamber defines with the ends of the thumbs pointing in the direction of the finger strip a mouth opening for the lock of the sheet pile wall component that is to be hooked in;

wherein at least one of the lock profiles is tilted, as viewed in the cross section, in relation to its predetermined coupling direction; and wherein the lock profile is tilted in such a manner that the lock of the sheet pile wall component that is to be hooked into the lock profile can be swiveled with its main direction of the application of force in a swivel range of at least ±8 degrees to ±12 degrees about the predetermined coupling direction.

14. The arrangement as recited in claim 13, wherein the two sheet pile wall components, which are coupled to the lock profiles of the connecting profile, the thumb strips of which are formed on the base body directly adjacent to each other, are sheet piles to which are coupled the other sheet piles, thus forming a sheet pile wall section that has the shape of a circular segment or a polygon, and that the last sheet pile of the sheet pile wall section in turn is hooked into a connecting profile.

15. The arrangement as recited in claim 14, wherein said sheet piles are union flat profiles.

16. The arrangement as recited in claim 13, wherein the lock profile, which is formed on the base body of the connecting profile adjacent to the two finger strips of both additional lock profiles, is connected to at least one sheet pile, which is coupled to a carrier element either directly or indirectly via other sheet piles, engaging with the sheet pile.

17. A connecting profile having a uniform cross section for interconnecting three sheet pile wall components, comprising:

three substantially identical lock profiles coupled together in predetermined directions for hooking sheet pile wall components, wherein each lock profile exhibits a thumb strip with a central web on which is molded a thumb;

said thumb strip runs at right angles to the longitudinal direction of said central web and projects beyond the central web;

wherein said curved finger strip points with its free end in the direction of the thumb strip and forms with the thumb strip a lock inner chamber; and said lock inner chamber is at least approximately elliptical or oval in cross section, and defines with the ends of the thumbs pointing in the direction of the finger strip a mouth opening for the lock of the sheet pile wall component that is to be hooked in;

wherein at least one of the lock profiles is tilted, as viewed in the cross section, in relation to its predetermined coupling direction; and wherein the lock profile is tilted in such a manner that the lock of the sheet pile wall component that is to be hooked into the lock profile can be swiveled with its main direction of the application of force.

* * * * *